United States Patent [19]

DeMars

[11] Patent Number: 4,715,505

[45] Date of Patent: Dec. 29, 1987

[54] GLASS HAVING MEANS FOR SWIZZLE STICK ATTACHMENT

[76] Inventor: Robert A. DeMars, 7932 Maestro Ave., Canoga Park, Calif. 91304

[21] Appl. No.: 862,616

[22] Filed: May 13, 1986

[51] Int. Cl.[4] ..... A47G 19/22; A47G 21/00; B65D 23/12

[52] U.S. Cl. ..... 215/100 R; 215/1 R; 215/1 C; 215/101; 215/DIG. 5; 215/DIG. 7; 220/85 D

[58] Field of Search ..... 215/100 R, 101, DIG. 5, 215/227, 1 R, 1 C, DIG. 7; 220/85 D; D7/6, 8, 42; 40/324; 206/459

[56] References Cited

U.S. PATENT DOCUMENTS

| | | | |
|---|---|---|---|
| D. 170,944 | 11/1953 | Robbins | D7/8 |
| D. 172,407 | 6/1954 | Warsager | D7/8 |
| D. 172,408 | 6/1954 | Warsager | D7/8 |
| D. 236,310 | 8/1975 | Yamato et al. | D7/6 |
| 700,653 | 5/1902 | Jobson | 215/227 |
| 1,327,439 | 1/1920 | Lewis | 215/100 R |
| 1,393,574 | 10/1921 | Rohmiller | 220/85 D |
| 2,736,657 | 2/1956 | Schares | 222/107 X |
| 2,845,194 | 7/1958 | Donnelly | 215/100 R X |
| 2,918,203 | 12/1959 | Hodgson | 220/85 D X |
| 3,080,081 | 3/1963 | Gram | 215/100 R X |
| 4,483,622 | 11/1984 | Muhi et al. | D7/42 X |

FOREIGN PATENT DOCUMENTS

| | | | |
|---|---|---|---|
| 2705806 | 9/1977 | Fed. Rep. of Germany | 40/324 |
| 272441 | 8/1927 | United Kingdom | D7/42 |

OTHER PUBLICATIONS

Charles Gurd & Co. Ltd., Table Glassware No. 12633-40/62.

"Sport Stirs", Nu-Pro-Corp., the Gift and Art Buyer, Jan. 1950, p. 106.

*Primary Examiner*—William Price
*Assistant Examiner*—Sue A. Weaver
*Attorney, Agent, or Firm*—Cislo & Thomas

[57] ABSTRACT

A novelty glass or the like made of glass or synthetic plastic wherein a representation or indicia of a sport figure in an action mode on or in the surface of the glass and wherein a bracket number is disposed in relation to the indicia representation to releasably hold a swizzle stick or the like which swizzle stick or the like is in the simulation of a member used in sports whether it be a baseball bat, tennis racket, or for example, ski pole, such that it appears that the swizzle stick is being actively held by the sport figure indicia or simulated representation, such that the swizzle stick is releasably held so that it may be conveniently in hand for use as a swizzle stick holder of olives, cherries or the like and for ease of association with the glass with which it is used after the swizzle stick has served its purpose.

7 Claims, 4 Drawing Figures

GLASS HAVING MEANS FOR SWIZZLE STICK ATTACHMENT

BRIEF SUMMARY OF THE INVENTION

Often times it is desirable to have a swizzle stick, mixer or holder of fruit, olives and the like in close proximity to one who imbibes alcoholic beverages. At stand-up cocktail parties and indeed at other social occasions where swizzle sticks are provided to stand up in the glass in which drinks are served, it becomes a difficulty in being able to satisfactorily dispose of the swizzle stick after it has served its purpose, whether it be for mixing the contents of the drink or for transporting the drink fruit, for example, a cherry or olive from the drink container itself to the mouth of the drinker.

With the herein-disclosed invention, after the swizzle stick has been used to either stir the drink or has been used to transport the cherry or olive or the like from the drink to the mouth of the drinker, the swizzle stick is easily disposed of by means of attachment of the swizzle stick to the exterior of the glass or cup as the casy may be.

In order to make the swizzle stick of the invention and the glass or container of the invention even more interesting, the swizzle sticks are fashioned so as to simulate members or articles found in various sports, such as, for example, a bat, tennis racket, a hockey stick or ski pole. Obviously other types of swizzle sticks representations may be utilized with it only being necessary that the particular sport article have some elongation in its design and to be able to represent the sport article of a particular sport and also be able to serve as a mixing rod or stirrer for the drink and additionally as a means for carrying a cherry, olive or piece of fruit or the like.

It is an object of the invention to provide a container, glass or cup that utilizes a sport figure representation depicting an action sport and wherein the glass, container or cup has disposed on the outer surface thereof a bracket member which is adapted to receive in releasable engagement a swizzle stick or like member which member simulates a sport article used in the particular sport that the sports figure representation or indicia portrays.

It is still another more specific, important object of the invention to provide a container having a bracket or the like member on the exterior thereof which is adapted to retain a swizzle stick or the like in releasable fashion with respect to the exterior surface of the container with which it is utilized.

It is still another, even more specific, important, object of the invention to provide a cup, glass or container that is provided with a pictorial representation of an action sport and wherein a bracket member is secured on the exterior of said glass, container or cup and which is adapted to receive a swizzle stick or the like in releasable fashion in the bracket secured to the outside of said glass cup or container, and wherein in the preferred mode the swizzle stick takes the form of a sports article that coincides with the sports figure represented in association with the glass, cup or container.

These and further objects will become apparent from the hereinafter following commentary taken in conjunction with the drawings wherein like numerals of reference designate like elements throughout.

DESCRIPTION OF THE BEST EMBODIMENTS CONTEMPLATED

Figure 1:
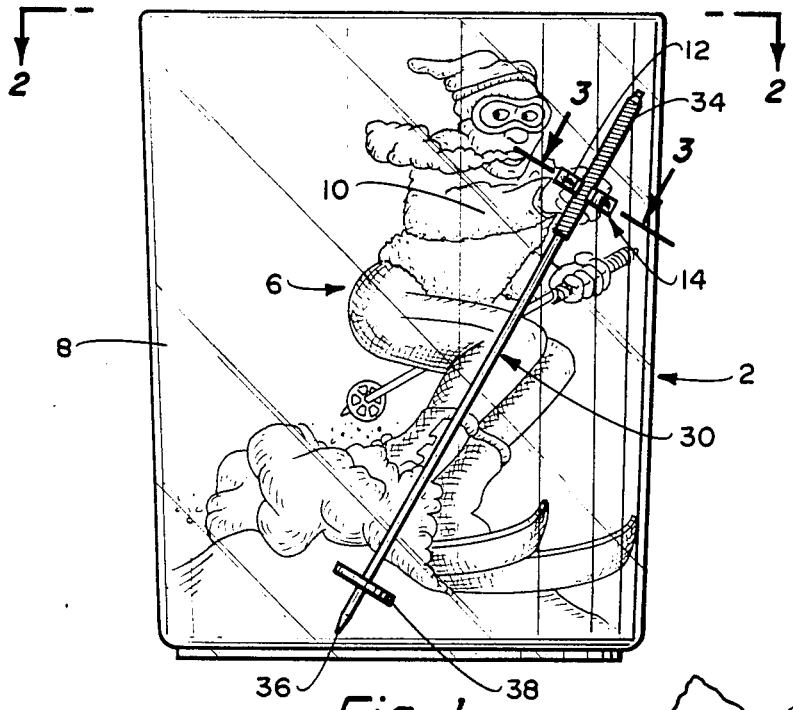
FIG. 1 is a side, elevational view of a specific embodiment of the invention showing a sports action figure such as a skier and illustrating a bracket member associated with the exterior of the transparent glass depicted and wherein a swizzle stick in the form of a ski pole is releasably retained within said bracket.
Figure 3:
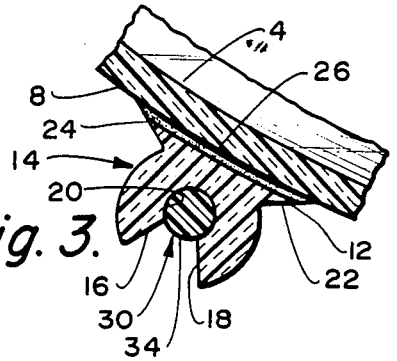
FIG. 3 is a view taken along the line 3—3 of FIG. 1.
Figure 2:
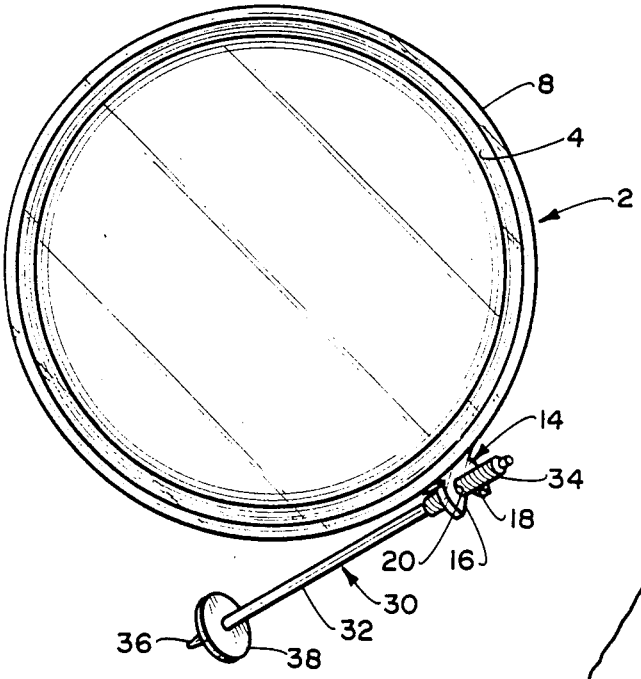
FIG. 2 is a view taken along the line 2—2 of FIG. 1.
Figure 4:
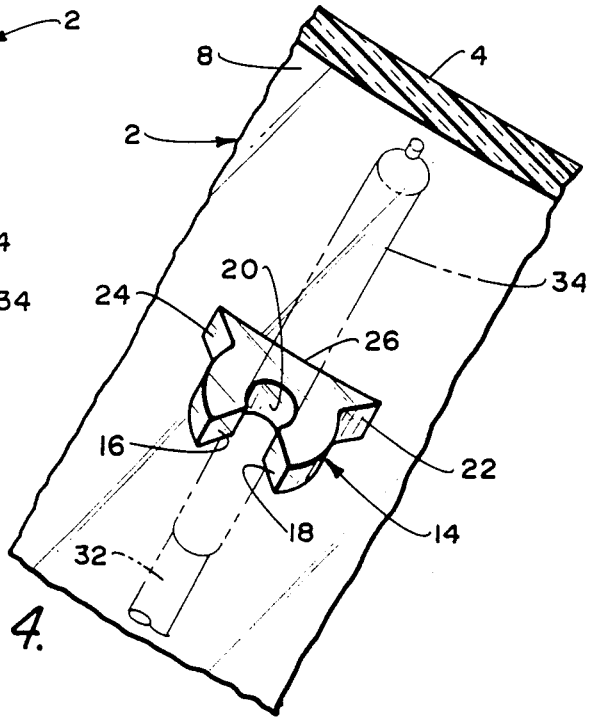
FIG. 4 is an enlarged fragmented view illustrating the bracket member of the invention.

Referring to the Figures of drawing, it will be noted in this particular instance a glass, container or cup 2 made of plastic or the like has the usual tumbler configuration having a rather wide mouth with a wide base of the type typically used for "on-the-rocks" drinks. While the glass 2 is shown as being made of plastic, it is contemplated that other materials of construction for glass 2 may be utilized, whether it be actual glass, plastic, metal or any such materials of construction, all of which are readily known in the art.

Secured to the inside surface 4 of glass 2 is a sports action figure such as 6 taking the form of a decal that may be applied to the interior surface 4 or for that matter to the exterior surface 8 of glass 2. It is, of course, possible that the glass 2 may be made of articulated sections wherein the sports action figure 6 representation or indicia may be interleaved between the articulated components making up, for example, the glass 2.

It is noted that the sports action figure representation 6 has an arm 10 in an elevated position terminating at a point 12 on the glass 2 whereat a bracket member 14 is secured to the exterior of the glass by means of bonding, adhesive or any similar such securement means depending upon the material of construction of glass 2.

The bracket member 14 is of a general C-shaped configuration having opposed jaws 16 and 18 and having an inwardly disposed opening or recess 20 to receive a swizzle stick, as will be described hereinafter. The bracket member 14 has outwardly flaring sections 22 and 24 terminating in a relatively flat base 26 which, of course, may be somewhat arcuate or configured to accommodate the size and shape of the glass 2 to which the bracket member 14 is secured, as earlier described. Suffice to say that the bracket member 14 is secured at the point 12 so as to cooperate and give the visual representation of being proximate and adjacent the arm 10 of the sports action FIG. 6. Preferably, the bracket member 14 is made of a resilient synthetic such as plastic wherein the jaws 16 and 18 are movable towards and away from each other so as to provide a releasable engagement recess or aperture 20 for the swizzle stick, as will now be described.

In this particular instance, the swizzle stick 30 is shaped in the form of a miniature ski pole to coincide with the sports action FIG. 6 representation of a skier. The swizzle stick 30 takes the usual form of an elongated rod portion 32 terminating in first end or handle portion 34 and having an opposed terminus with a sharpened end 36 with the circular member 38, very much like an actual ski pole.

It is, of course, within the contemplation of the invention that the swizzle stick 30 take other forms of representation to coincide with the sports action figure representation depicted in association with the glass 2. For example, if the sports action figure is a baseball player, a baseball bat swizzle stick may be fashioned so as to coincide with the sport being depicted. Obviously depending upon the sports action figure being depicted and the particular sport and indeed the sport article or implement used in that sport, the sports action figure will take various stances. For example, if it were baseball, the sport action figure may be so disposed so as to have a bat rest in the batting position in which case the swizzle stick would take the form of a bat. Likewise should the sports action figure be of a fisherman, the swizzle stick would take the form of a fly rod or the like, it only being important that the swizzle stick co-act with the sports action figure being depicted so as to visually convey meaningfulness of having a swizzle stick in association with the particular sports action figure. While it is contemplated that the swizzle stick 30 take the form of an article used in the particular sport, it is indeed possible and in some cases may be desirable that the swizzle stick be those commonly found in conventional usage in which event the bracket member 14 would be similarly modified to accommodate existing swizzle sticks, in which event the swizzle stick would be available for use as previously described for the swizzle stick 30 of the invention whether it be for mixing or stirring the drink or for securing cherries, olives, etc, and after such usage the swizzle stick may be then disposed on the glass exterior by means of the bracket 14.

While the invention has been disclosed with respect to a synthetic plastic glass, which is transparent in nature, the invention is not intended to be so delimiting. In other words opaque glasses, cups or containers may be utilized wherein the sports action figure or indeed any other figure is placed on the exterior of the glass, cup or container and the bracket utilized as previously disclosed in conjunction with the disclosed invention.

Thus there has been disclosed a unique novelty cup, glass or container which has the ability of releasably securing and holding a swizzle stick or the like whether it be in the form of a sport article or not, in a manner that allows subsequent and serial uses of the swizzle stick in conjunction with the glass container or cups with which the bracket member for holding the swizzle stick may be utilized.

Various modifications, alterations and changes will at once make themselves apparent to those of ordinary skill in the art and all such changes, modifications and alterations are intended to be covered by appended claims.

I claim:

1. A novelty glass, container, cup or the like comprising the combination:

a container capable of being held by the human hand and having on the exterior sidewall thereof a protruding bracket member adapted to receive in releasable fashion a swizzle stick or the like, wherein said swizzle stick or the like simulates a sport or the like member and wherein a sport figure representation or indicia cooperates with said bracket member so as to simulate said sport figure representation or indicia actively utilizing said sport or the like member making up said swizzle stick.

2. The novelty glass, container, cup or the like in accordance with claim 1 wherein said glass, container or cup is of integral plastic and said bracket member is secured to the outside surface thereof.

3. The glass, container, cup or the like in accordance with claim 1 wherein said bracket member is fusion bonded to said glass, container, cup or the like which is of integral plastic material, and wherein said bracket member provides for friction-fit retention of said swizzle stick.

4. The glass, container, cup or the like in accordance with claim 3 wherein said sport figure representation is located on the inside surface of said glass, container, cup or the like.

5. The glass, container, cup or the like in accordance with claim 4 wherein said sports figure representation indicia is in the form of a skier.

6. The glass, container, cup or the like in accordance with claim 5 wherein said swizzle stick is in the form and configuration of a ski pole.

7. A novelty glass or the like comprising the combination of a container capable of being held by the human hand and having on the exterior thereof a bracket member having an inwardly disposed opening with opposed and adjacent resilient jaws wherein said bracket member is adapted to receive in releasable fashion within said opening and between said resilient jaws a swizzle stick or the like wherein said swizzle stick simulates a sport or the like member and including a sport figure representation and indicia cooperating with said bracket member so as to simulate said sport figure actively utilizing said sport or the like member received within the said bracket member.

* * * * *